US007510440B2

(12) United States Patent
Lin et al.

(10) Patent No.: US 7,510,440 B2
(45) Date of Patent: Mar. 31, 2009

(54) CONNECTOR WITH FILTER FUNCTION

(75) Inventors: Shin-Way Lin, Taoyuan County (TW); Hsin-Hsien Li, Changhua County (TW); Ben-Hwa Jang, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/775,235

(22) Filed: Jul. 10, 2007

(65) Prior Publication Data

US 2008/0233802 A1 Sep. 25, 2008

(30) Foreign Application Priority Data

Mar. 23, 2007 (TW) ..... 96110071

(51) Int. Cl.
*H01R 13/66* (2006.01)

(52) U.S. Cl. ..... 439/620.07; 439/608; 439/620.14

(58) Field of Classification Search ..... 439/50, 439/607, 620.09, 608, 941, 620.07, 620.14; 333/182–184, 185
See application file for complete search history.

(56) References Cited

U.S. PATENT DOCUMENTS

| | | | | |
|---|---|---|---|---|
| 4,874,908 | A * | 10/1989 | Johansson | 174/72 A |
| 6,438,000 | B1 * | 8/2002 | Okamoto et al. | 363/40 |
| 6,565,387 | B2 * | 5/2003 | Cohen | 439/608 |
| 6,776,649 | B2 * | 8/2004 | Pape et al. | 439/485 |
| 7,322,856 | B2 * | 1/2008 | Laurx et al. | 439/608 |
| 7,341,474 | B2 * | 3/2008 | Clem | 439/424 |

* cited by examiner

*Primary Examiner*—Michael C Zarroli
(74) *Attorney, Agent, or Firm*—Jianq Chyun IP Office

(57) ABSTRACT

A connector with filter function is provided. The connector has a plurality of terminal lines and plastic packages for enclosing the terminal lines. Each of the terminal lines and plastic packages/dielectric material are formed with periodically repeated pattern, so that equivalent capacitors and inductors are formed in the connector. Therefore, the connector also functions as a filter.

10 Claims, 18 Drawing Sheets

CONNECTOR WITH FILTER FUNCTION

CROSS-REFERENCE TO RELATED APPLICATION

This application claims the priority benefit of Taiwan application serial no. 96110071, filed Mar. 23, 2007. All disclosure of the Taiwan application is incorporated herein by reference.

BACKGROUND OF THE INVENTION

1. Field of the Invention

The present invention relates to a connector. More particularly, the present invention relates to a connector capable of filtering signals.

2. Description of Related Art

In the processing of electronic circuits, existence of noises or unnecessary signals may cause certain influence on the precision of signal processing. Thus, in circuit design, filters are required to filter the noises, signals of specific frequency bands, or unnecessary signals, so as to obtain purer signals, thereby making the subsequent signal processing more precise to further satisfy the requirement.

Generally speaking, it had better thoroughly eliminate the noises upon that the signals are received. The signal receiving end is usually provided with a connector connected to various elements or signal lines. Further, limited by the size of the connector, and as the connector design mainly considers problems such as impedance matching and crosstalk, the filter function is usually provided at the system side or each circuit module.

However, if the filter function is provided with the connector, the received signals can be purer. Moreover, the designers of the system and circuit modules can save their energy poured on designing a filter component in the system or each circuit module, and make more efforts on the design of the circuit or the system itself.

SUMMARY OF THE INVENTION

In view of the above problems, the present invention is directed to provide a connector with filter function, such that the signal is sufficiently filtered in the connector in advance.

The present invention provides a connector with filter function, which comprises a plurality of terminal lines, a dielectric layer, and a plurality of plastic packages. The terminal lines are arranged in an array structure, and an input side and an output side of each of the terminal lines are substantially arranged linearly. Each of the terminal lines is arranged periodically and repeatedly with a predetermined periodic unit pattern. The dielectric layer is filled between the terminal lines to support the entire structure and arranged periodically. The plastic packages respectively encloses the terminal lines with a certain space in between.

Moreover, the present invention further provides a connector with filter function, which includes a first substrate, a plurality of first terminal lines, a case, a second substrate, and a plurality of second terminal lines. The first substrate has a first surface and a second surface opposite to each other. Each of the first terminal lines is formed on the first surface of the first substrate, in which each of the first terminal lines is further arranged periodically and repeatedly with a predetermined periodic unit pattern. The case is connected to one side end of the first substrate. The second substrate also has a first surface and a second surface opposite to each other, and is disposed in the case. Each of the second terminal lines is formed on the first surface of the second substrate, and electrically connected to each first terminal line on the first substrate.

Further, the present invention further provides a connector with filter function, which includes a plurality of terminal lines, a dielectric layer, and a plastic package. The terminal lines are arranged in an array structure, each of the terminal lines has a plurality of bent portions, such that an input side and an output side of each of the terminal lines form a predetermined angle. Each of the terminal lines is arranged periodically and repeatedly with a predetermined periodic unit pattern. The dielectric layer is filled between the terminal lines. The plastic package is used for enclosing the terminal lines and exposing the two end portions of each of the terminal lines to respectively serve as an input end and an output end.

In summary, instead of adding electronic components, the filter function of the connector is achieved by altering the shape of the elements of the connector. Thus, the structure of the connector remains light and flexible without needs of extra space. Further, as the connector is fabricated by an existing process and devices, no extra cost is required.

In order to make the aforementioned and other objectives, features, and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The configurations of different connectors are given below for illustrating the structure of a connector with filter function.

The First Embodiment

Figure 1A:
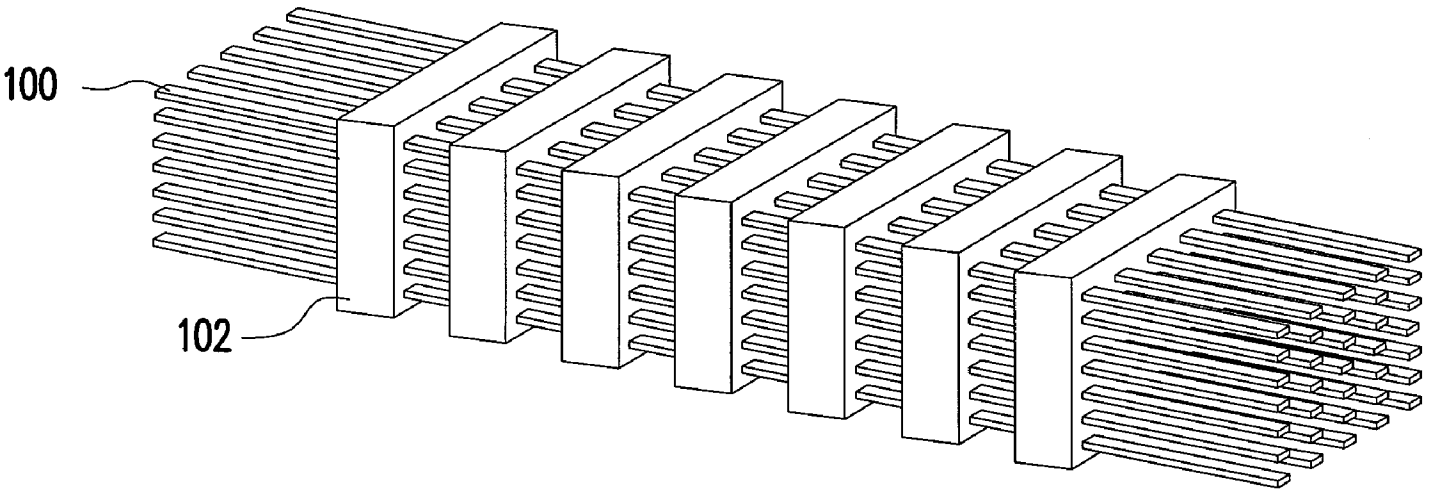
FIGS. 1A and 1B schematically illustrate perspective views of an array-type periodic structure according to one embodiment of the present invention.
Figure 1B:
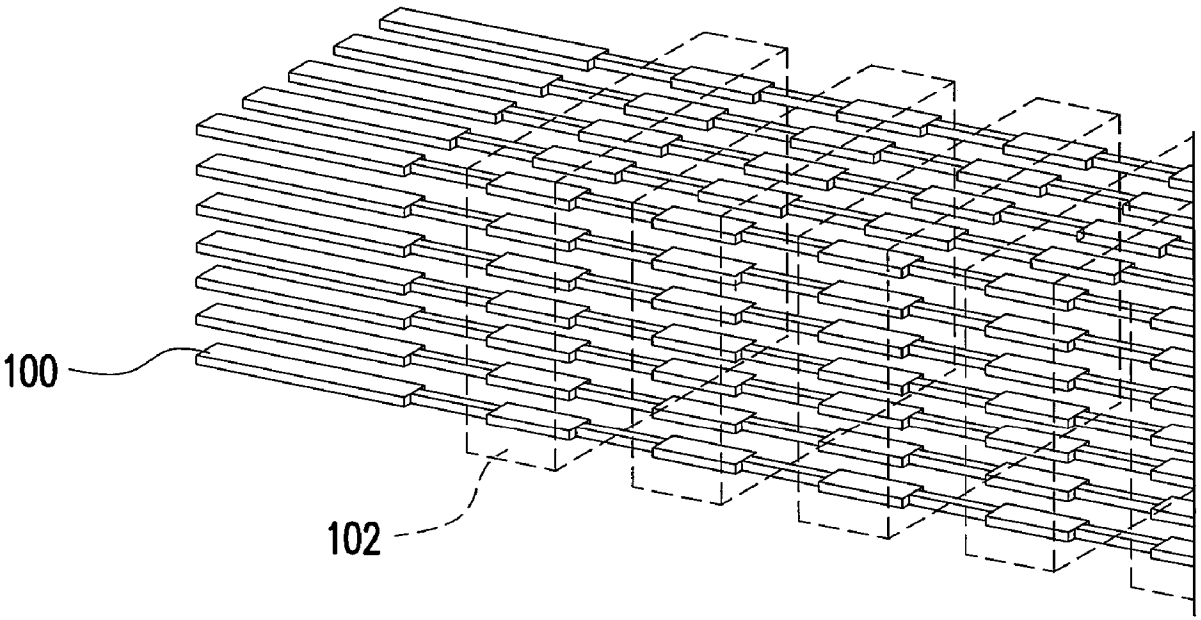

FIGS. 1A and 1B schematically illustrate perspective views of a periodic structure of terminal lines in an array-type connector according to one embodiment of the present invention. Referring to the figures, the terminal line array is a kind of 180° structure, i.e., the input and output portions of the terminal lines are arranged linearly. As shown in FIG. 1A, the connector comprises a plurality of terminal lines (terminal line repeating units) 100 arranged in an array structure. The array structure can be a two-dimensional or three-dimensional array, and the terminal lines arranged in a three-dimensional structure are shown in this embodiment. Further, the connector further comprises a plurality of plastic packages 102, for enclosing the terminal lines 100 with a certain space in between. The plastic packages 102 arranged with a space in between also form a periodic structure.

As shown in FIG. 1B, each of the terminal lines 100 is presented periodically and repeatedly with a certain pattern. For example, seen from the plan view of the terminal lines 100, each of the terminal lines 100 is formed by repeatedly connecting a repeating unit in the manner of "wide-narrow-wide" of the width while extending in the longitudinal direction. Each of the plastic packages 102 encloses the portion with a larger width of each terminal line repeating unit. Thus, as shown in FIG. 1B, the plastic packages 102 are also arranged periodically in accordance with the periodicity of the terminal lines.

Generally, dielectric material is filled between the array-type terminal lines 100 of the connector. The area of each terminal line can be changed by varying the pattern width of the terminal line. Thus, a filter circuit can be formed in the connector through the equivalent capacitors and inductors formed by dielectric filling the surface area and cross-sectional area of the terminal line. In general, the capacitor effect becomes greater as the area is getting larger. The inductance is controlled by controlling the length and width of each terminal line. Therefore, in design, the width, length, and cross-sectional height of each terminal line are adjusted to control the capacitors and inductors, so that properties of the filter can be controlled.

Further, the plastic packages 102 are plastic, and have dielectric properties. Thus, the capacitance can be further adjusted by altering the coverage space that encloses the terminal lines 100 by the plastic packages 102. In addition, the plastic packages 102 also function to fix the terminal lines 100.

Figure 2A:
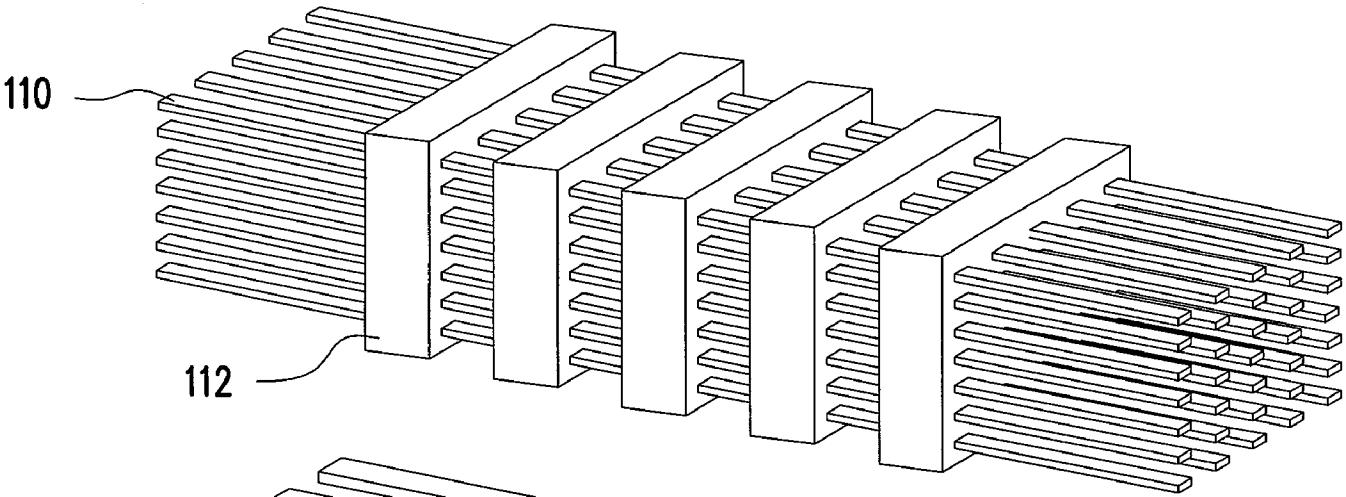
FIGS. 2A and 2B schematically illustrate perspective views of another array-type periodic structure according to one embodiment of the present invention.
Figure 2B:
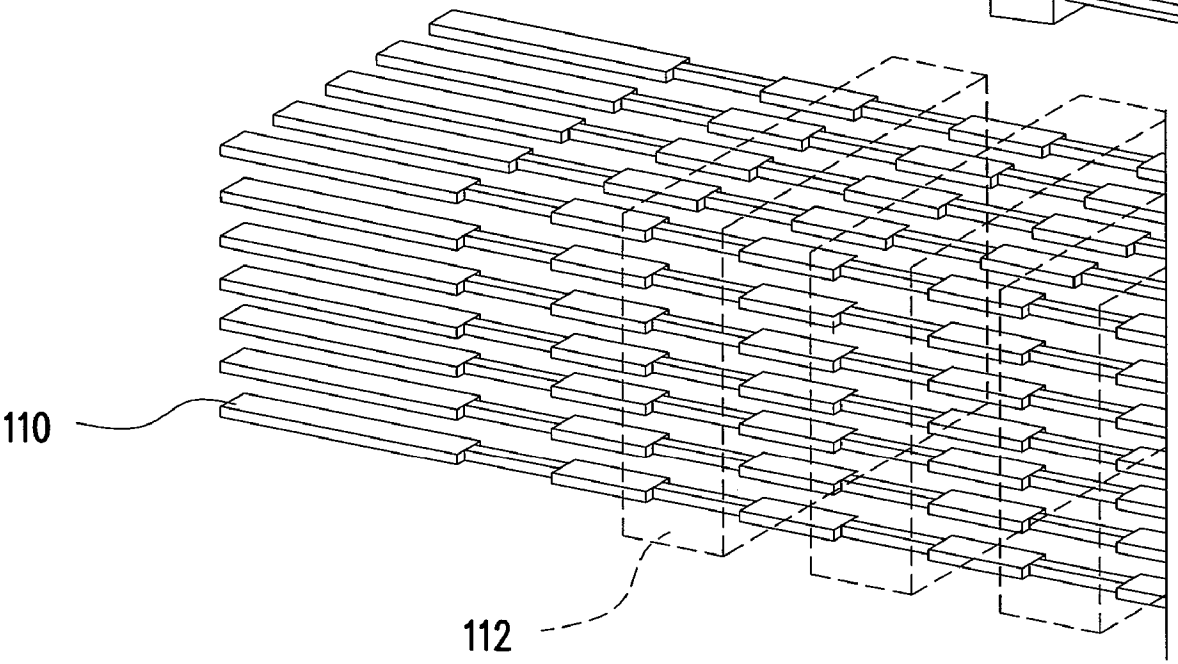

FIGS. 2A and 2B schematically illustrate perspective views of the periodic structure of terminal lines in another array-type connector according to one embodiment of the present invention. FIGS. 2A, 2B and FIGS. 1A, 1B show similar structures, and the difference is that each of the plastic packages 112 in FIGS. 2A, 2B encloses the portion with a narrow width of each terminal line repeating unit 110. The positions enclosed by the plastic packages 102, 112 are not particularly restricted and can be adjusted properly on demands. Further, controlling the capacitors and inductors is the same as mentioned before, and the details will not be described herein again.

Figure 3:
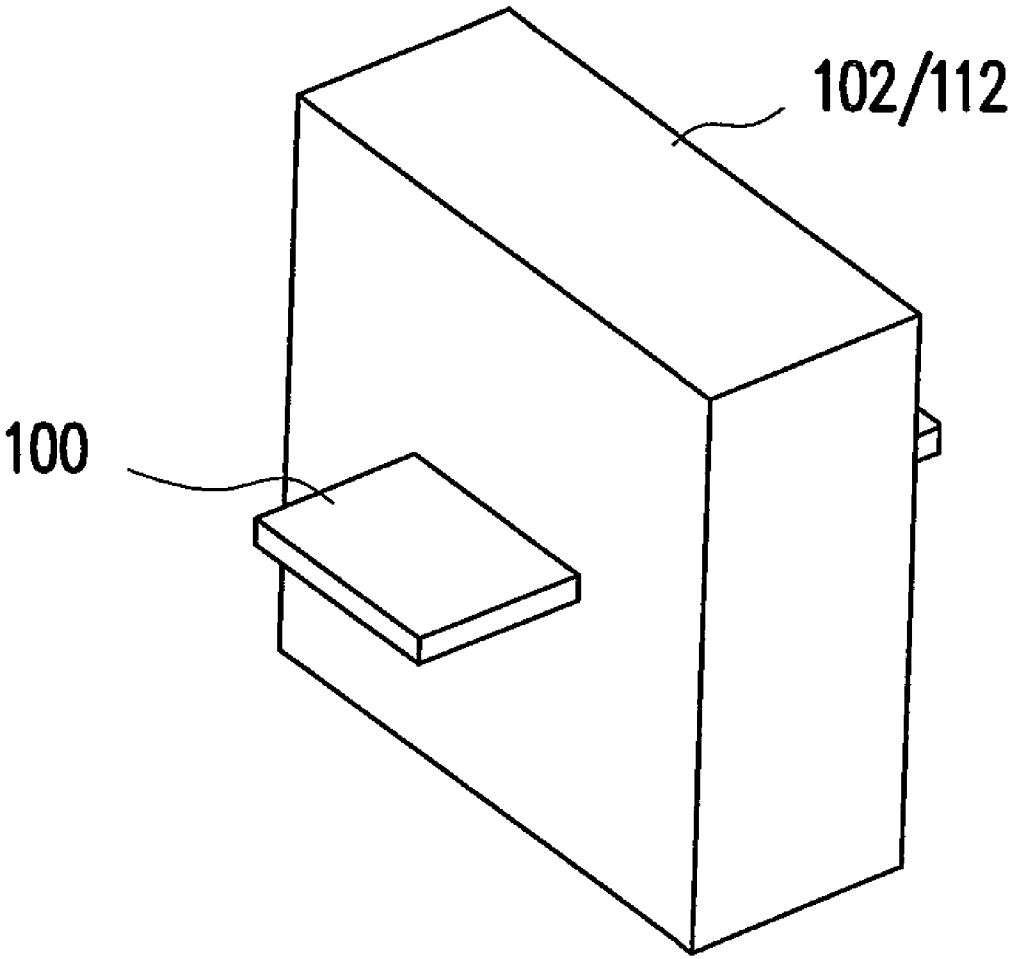
FIG. 3 illustrates one unit of the periodic structures shown in FIGS. 1A, 1B, and 2A, 2B.

FIG. 3 shows one unit of the periodic structures in FIGS. 1A, 1B, and 2A, 2B. For simplicity, FIG. 3 only shows one terminal line unit 100 enclosed by a plastic package 102 (or 112). The structure of a periodic array-type connector is obtained by repeatedly extending the structure in FIG. 3. Examples of terminal lines 100 (or 110) will be given below.

Figure 4B:
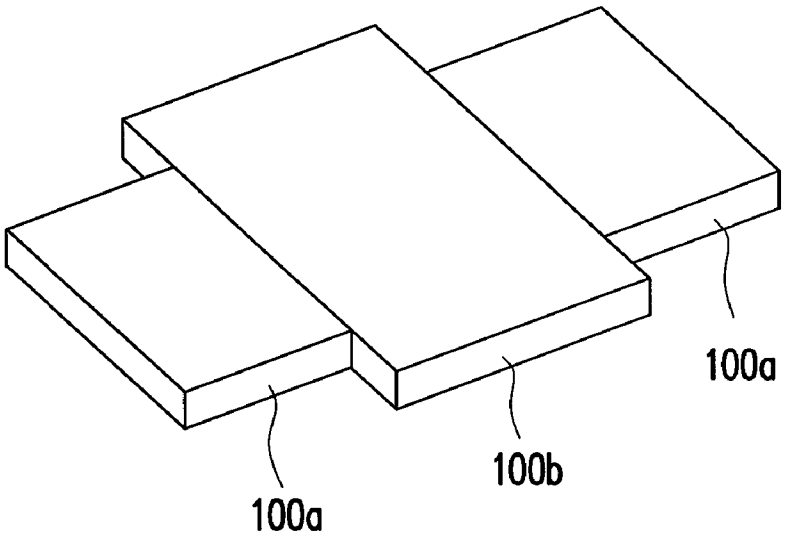
FIGS. 4A-4F schematically illustrate the periodic structure of a terminal line for an array-type connector.
Figure 4A:
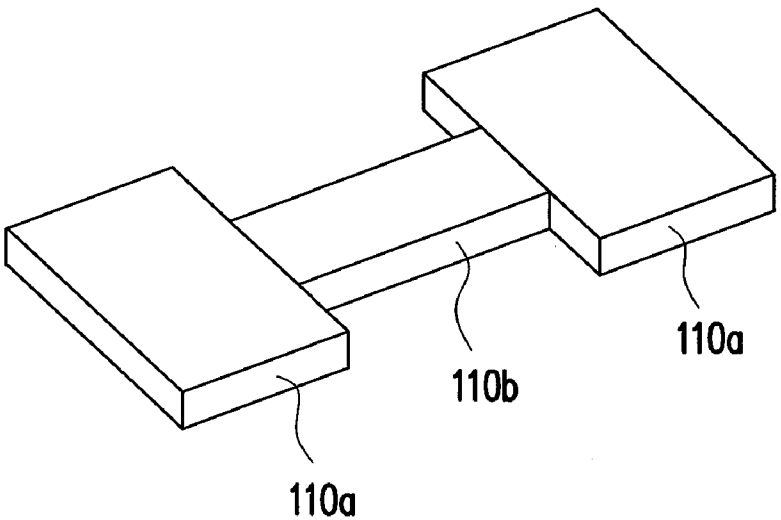

FIGS. 4A-4F schematically illustrates examples the periodic structure of a terminal line in an array-type connector, and the terminal line is suitable for the structures in FIGS. 1B or 2B. As shown in FIG. 4A, the terminal line extends in the longitudinal direction in the form of a wide portion 110*a*, a narrow portion 110*b*, and a wide portion 110*a*, so as to form the pattern of a terminal line 110. That is, the terminal line 110 is formed with a periodically repeated pattern in the manner of a wide-narrow-wide-narrow-wide- . . . pattern. In FIG. 4B, the terminal line extends in the longitudinal direction in the form of a narrow portion 100*a*, a wide portion 100*b*, and a narrow portion 100*a*, so as to form the pattern of a terminal line 100. That is, the terminal line 100 is formed with a periodically repeated pattern in the manner of a narrow-wide-narrow-wide-narrow-wide- . . . pattern.

Figure 4D:
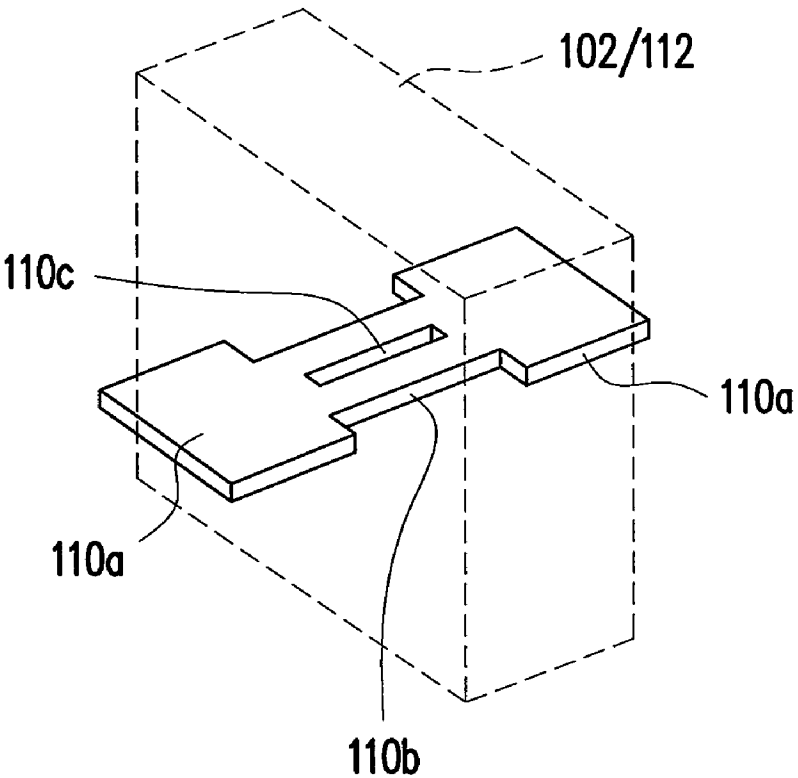
Figure 4C:
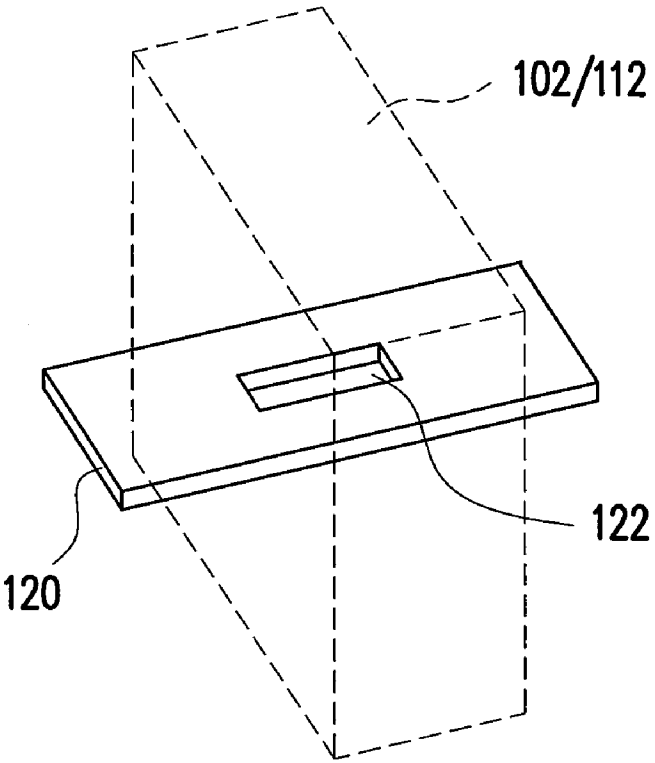

FIG. 4C shows another structure of the terminal line repeating unit. As shown in the FIG. 4C, the terminal line repeating unit 120 is substantially a cuboid with identical width. An opening 122 is formed at the center of the repeating unit, such that the terminal line is of a periodic structure. The opening 122 is located at a position enclosed by the plastic package 102/112. FIG. 4D shows a variation of FIG. 4A, in which an opening 110*c* is added in the portion 110*b* with a narrow width at the center. FIG. 4E shows a variation of FIG. 4B, in which an opening 100*c* is added in the portion 100*b* with a wide width at the center. In the structures of FIGS. 4C-4E, an opening is added at the center of the terminal line repeating unit, and the number of the opening is not limited to one. The position of the opening is not particularly restricted, and can be designed upon practical demands.

Figure 4F:
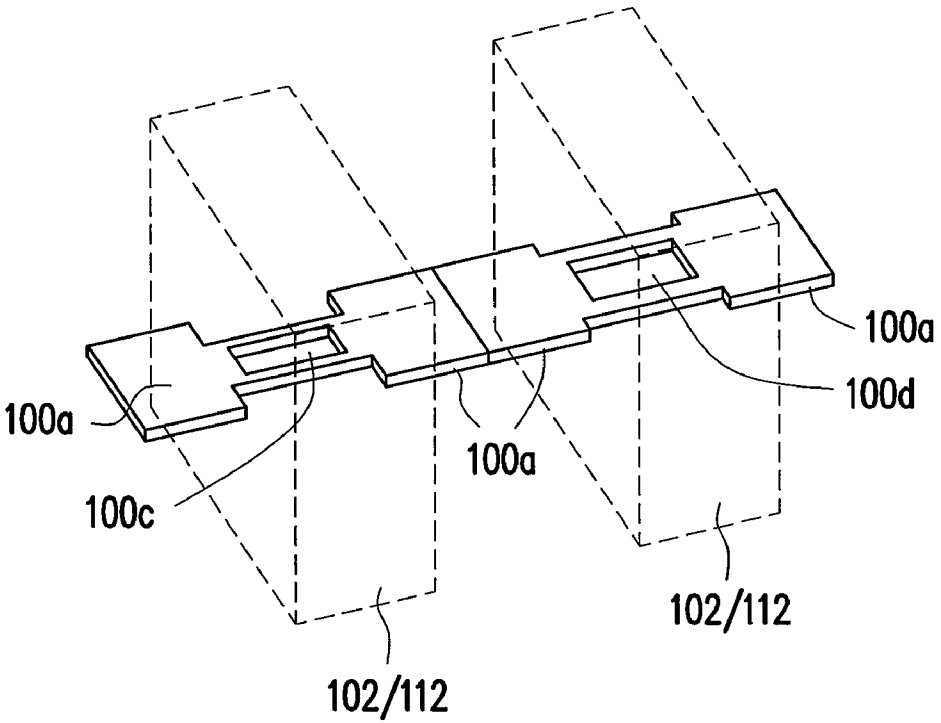
Figure 4E:
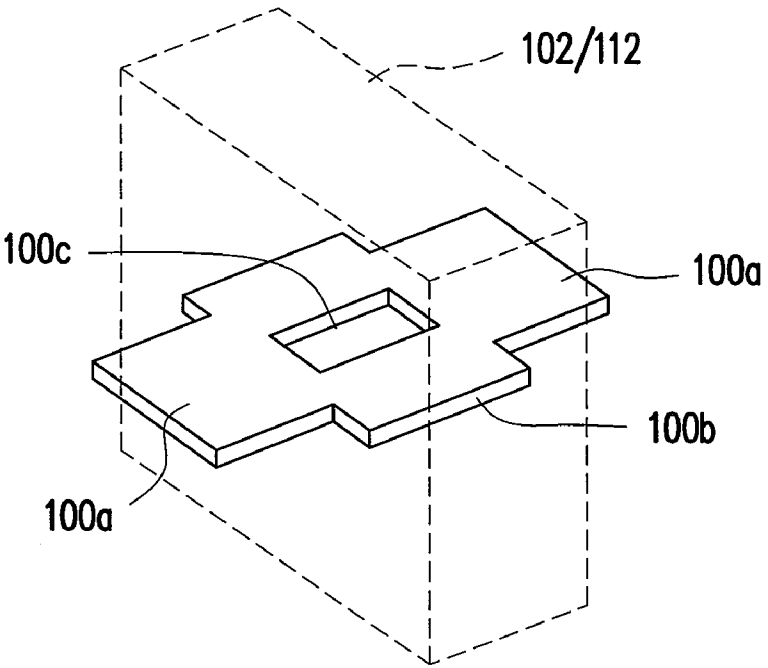

FIG. 4F shows the structure of another terminal line. The aforementioned repeating portion is substantially arranged periodically and repeatedly with the same pattern. FIG. 4F shows a terminal line pattern arranged periodically and repeatedly with different patterns. As shown in FIG. 4F, the center opening 100*c* of the left terminal line portion and the center opening 100*d* of the right terminal line portion are different in size, i.e., the terminal line is arranged periodically and repeatedly with two different unit patterns.

Moreover, the structure of FIG. 4F shows a basic repeating unit with two openings of different sizes in two adjacent units. However, the same purpose can be achieved by altering the wide portion. For example, two units as shown in FIG. 4A can be employed, each having a different wide portion 110*a*. In addition, the above examples can be matched at random, and it is not limited to adopting two or three units. The practical configuration can be determined upon design requirements. Further, FIGS. 4A-4F only show several examples, and those skilled in the art can design the pattern at will.

The pattern can be formed into a periodically repeated pattern by etching, stamping, etc. Of course, other possible methods can be utilized as long as the pattern of the terminal line changes periodically and repeatedly.

The Second Embodiment

Figure 5A:
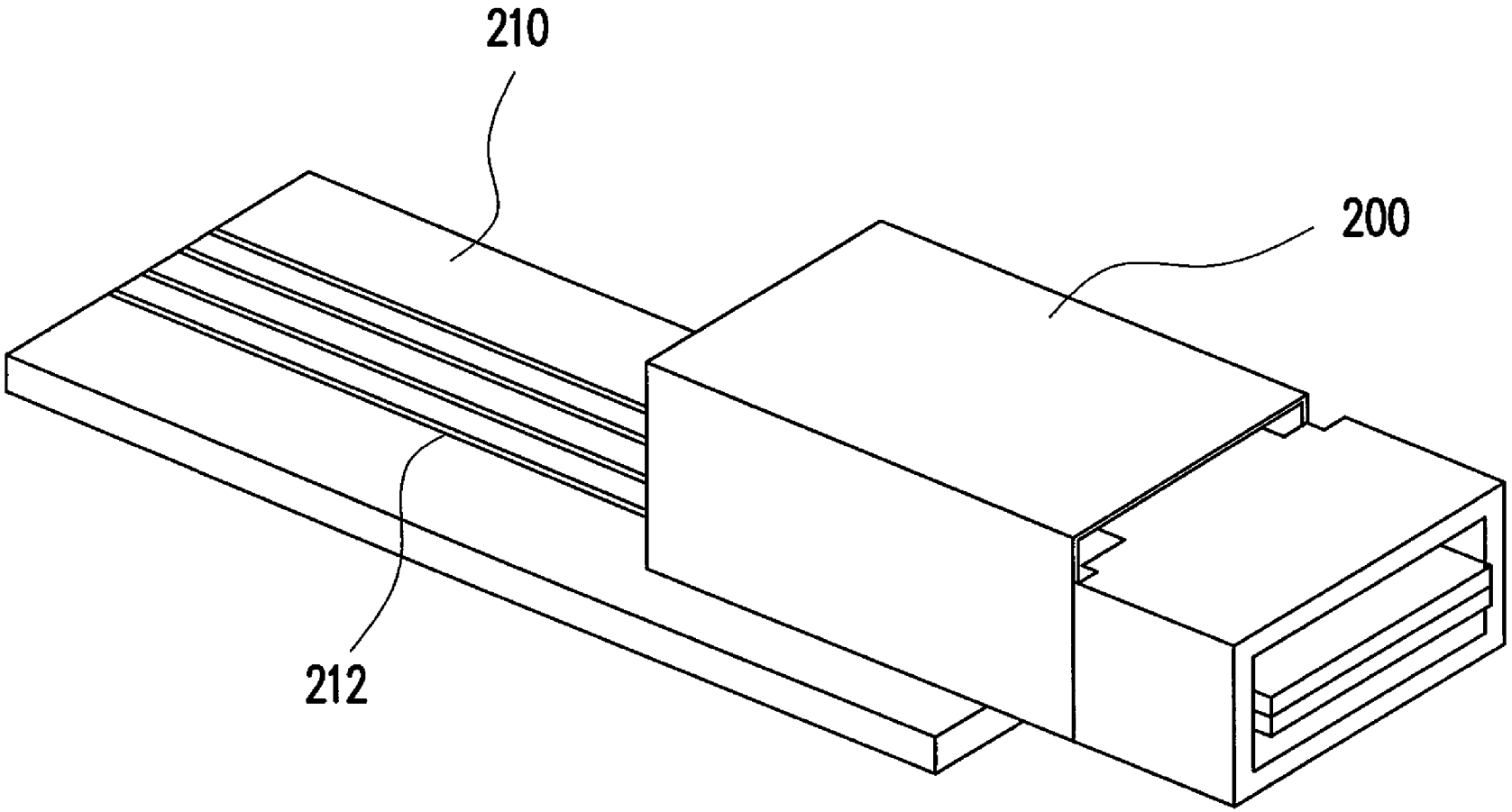
FIG. 5A schematically illustrates the structure of a PCB-type connector.

The structure of a PCB-type connector is illustrated below. FIG. 5A is a schematic perspective view of a PCB-type connector. FIG*s*. 5B and 5C are schematic views of applying the periodic structure of this embodiment. As shown in FIG*s*. 5A-5C, the PCB-type connector includes a PCB 210 with terminal lines 212 disposed thereon, and a case (or dielectric material, serving as a dielectric layer) 200 used for electrically connected to the PCB 210 via a PCB 230. In the PCB-type connector, each terminal line is made into a periodic structure like the terminal line 212 on the PCB 210 in FIG. 5B, or the terminal line 232 on the PCB 230 in FIG. 5C.

Figure 5C:
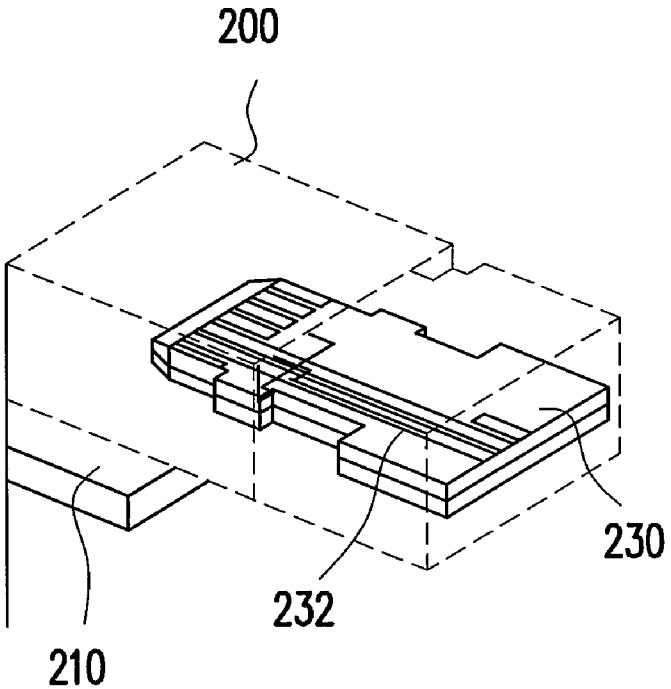
FIGS. 5B and 5C schematically illustrate portions capable of applying the periodic structure for the embodiment in FIG. 5A.
Figure 5B:
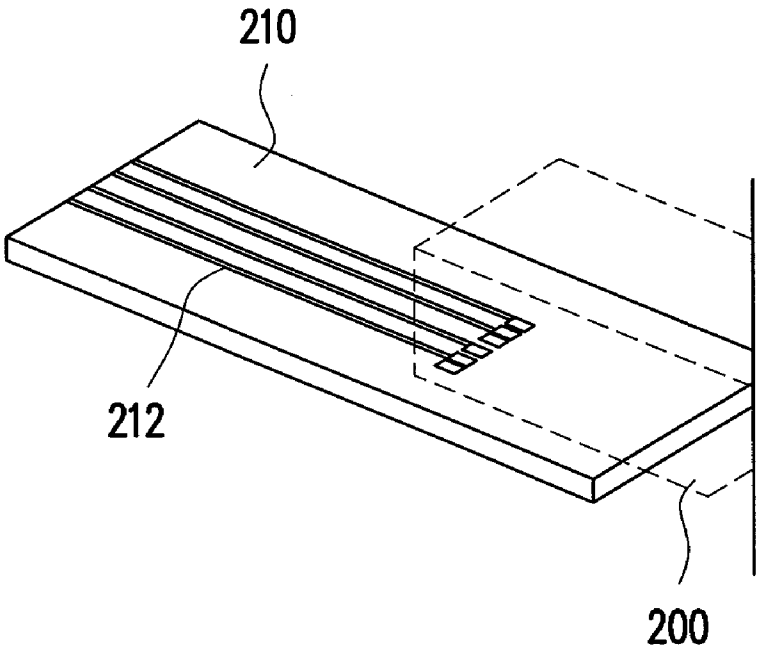
Figure 6B:
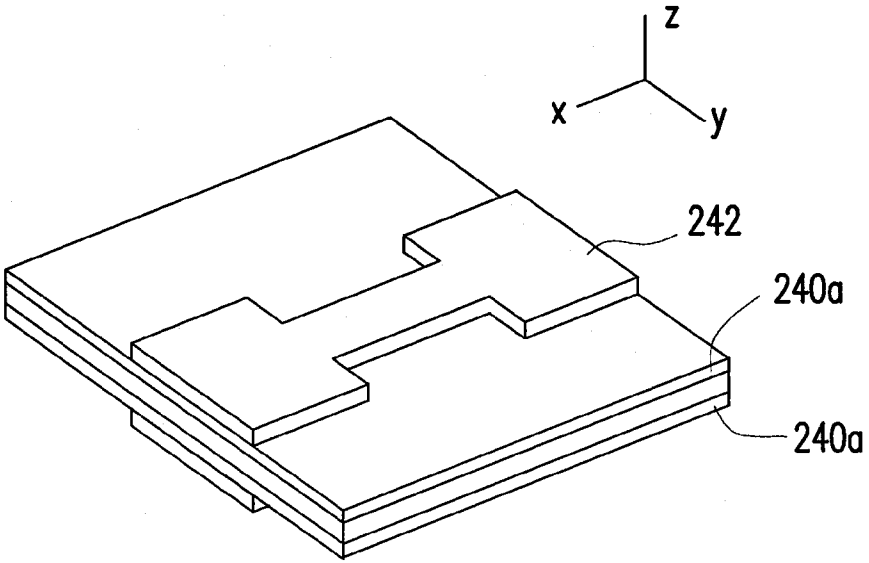
FIGS. 6A-6J schematically illustrate examples of the periodic structure of a terminal line for a PCB-type connector.
Figure 6A:
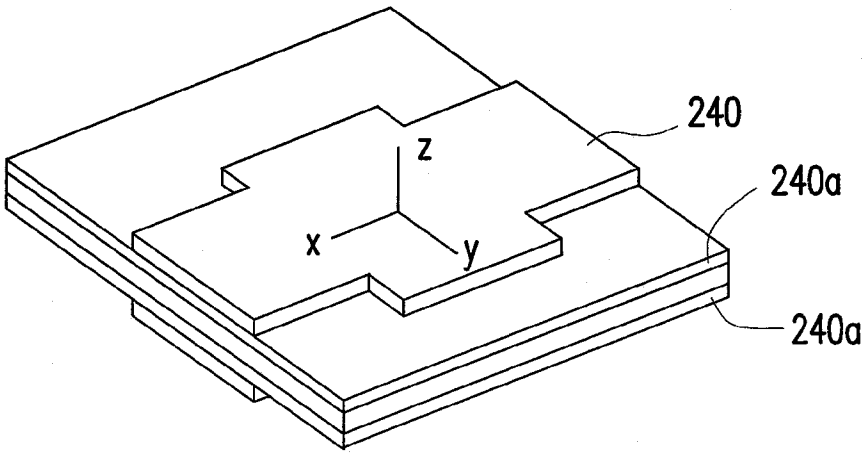

Several examples are given below to illustrate the periodically repeated pattern of each terminal line in FIG. 5B or 5C. FIG*s*. 6A-6J are schematic views of the periodic structure of a terminal line in a PCB-type connector with dielectric layers 240*a*, and only the periodically repeating unit of the terminal line is shown. As shown in FIG. 6A, the periodically repeating unit is a dual-layer structure, with a terminal line 240 respectively formed on the upper and lower sides of the PCB. The terminal line 240 is patterned into a structure wide at the center and narrow at two sides. FIG. 6B also shows a dual-layer terminal line structure. The structure of the terminal line 242 has a recess with a narrow width at the center, and two sides with a wide width.

Figure 6D:
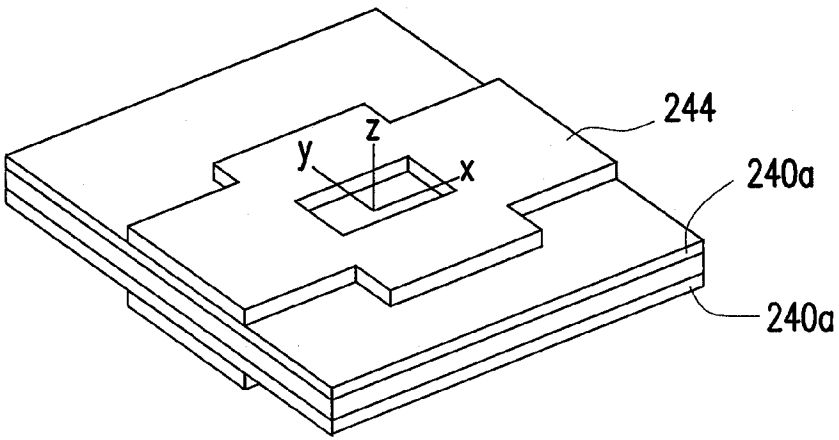
Figure 6C:
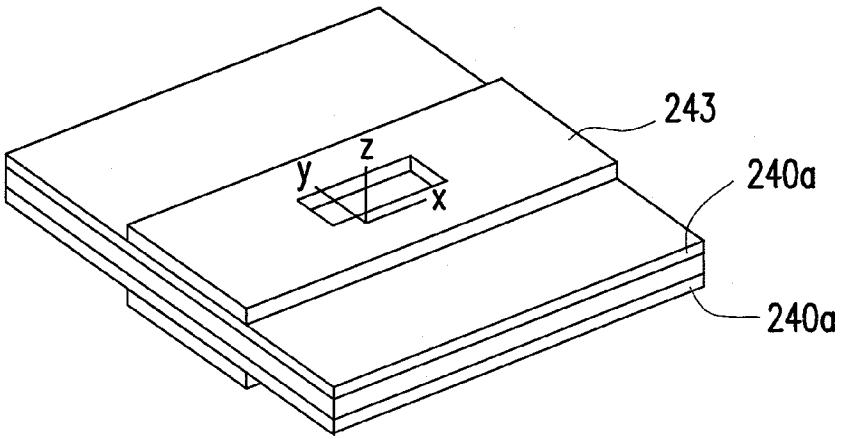
Figure 6E:
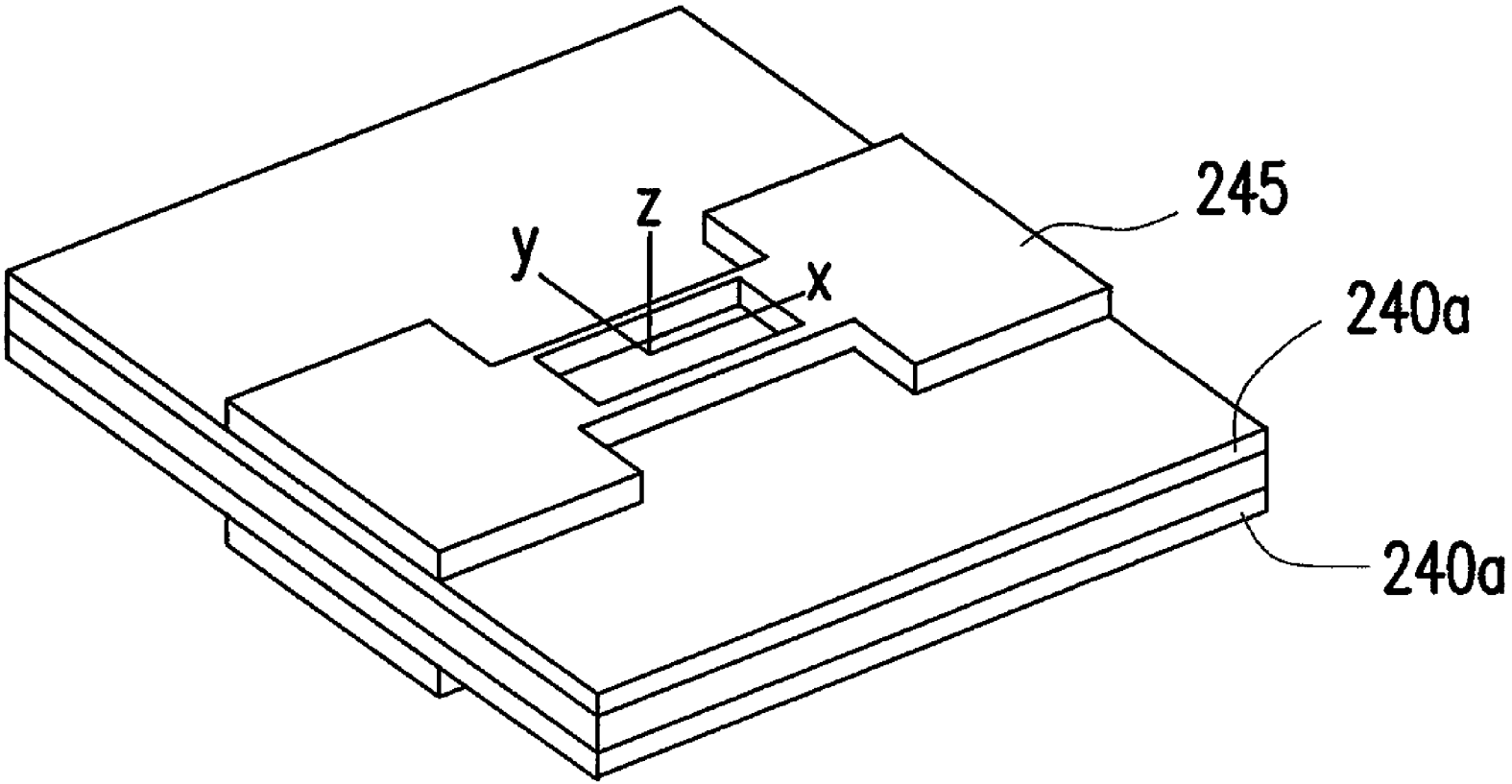

FIG. 6C also shows a terminal line of a dual-layer structure. The width of the terminal line 243 is the same, and an opening is formed at the center. The terminal line 244 shown in FIG. 6D is a variation of FIG. 6A, and an opening is formed at the center. The terminal line 245 shown in FIG. 6E is a variation of FIG. 6B, and an opening is formed at the center.

Figure 6F:
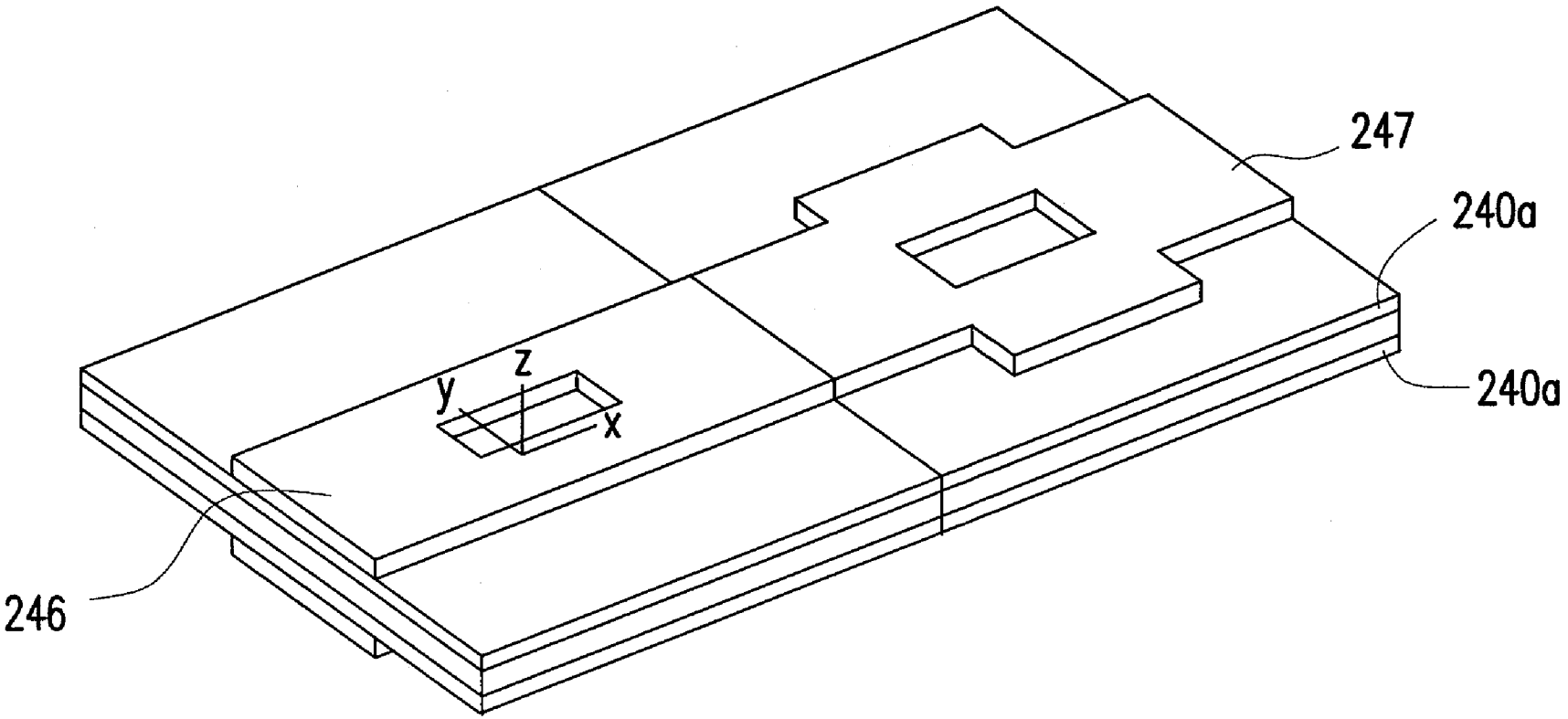
Figure 6G:
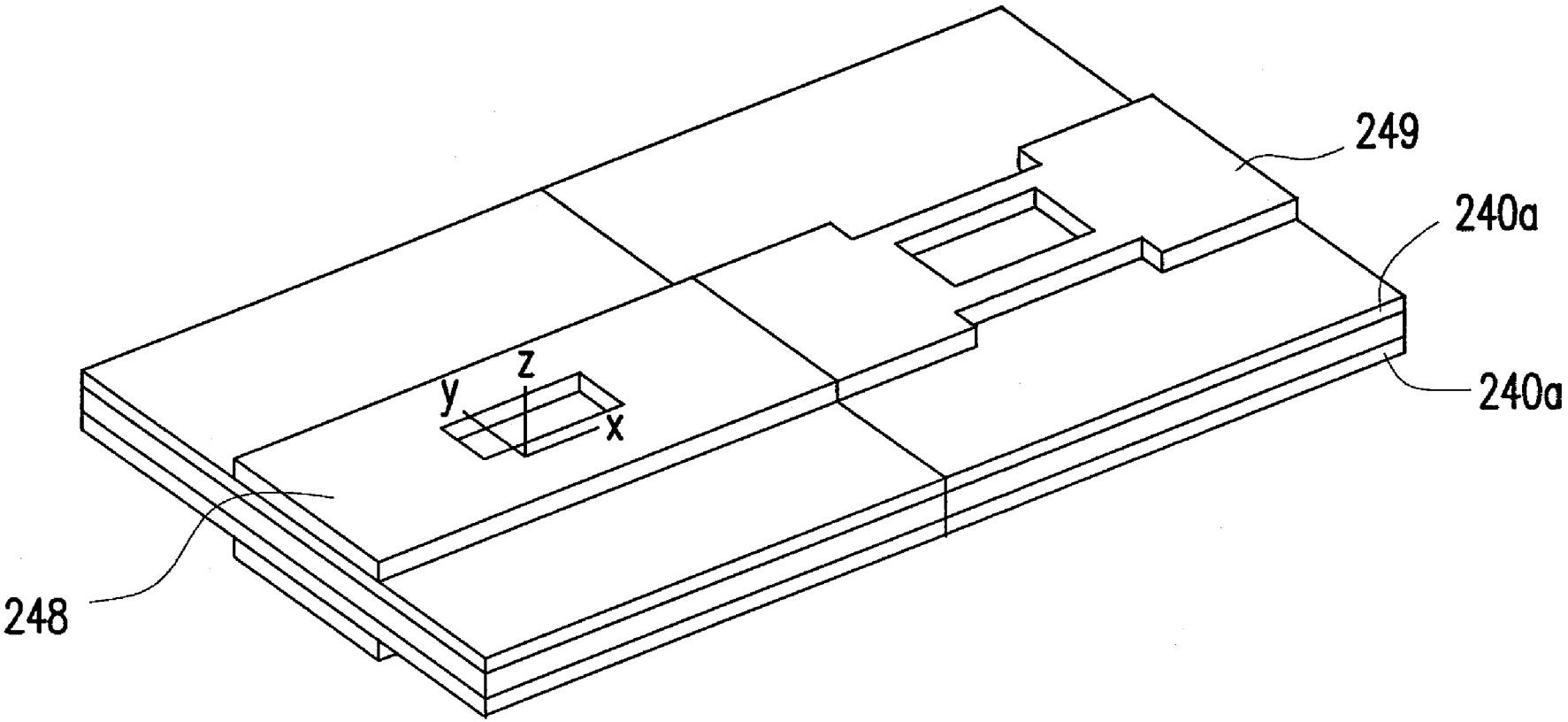
Figure 6H:
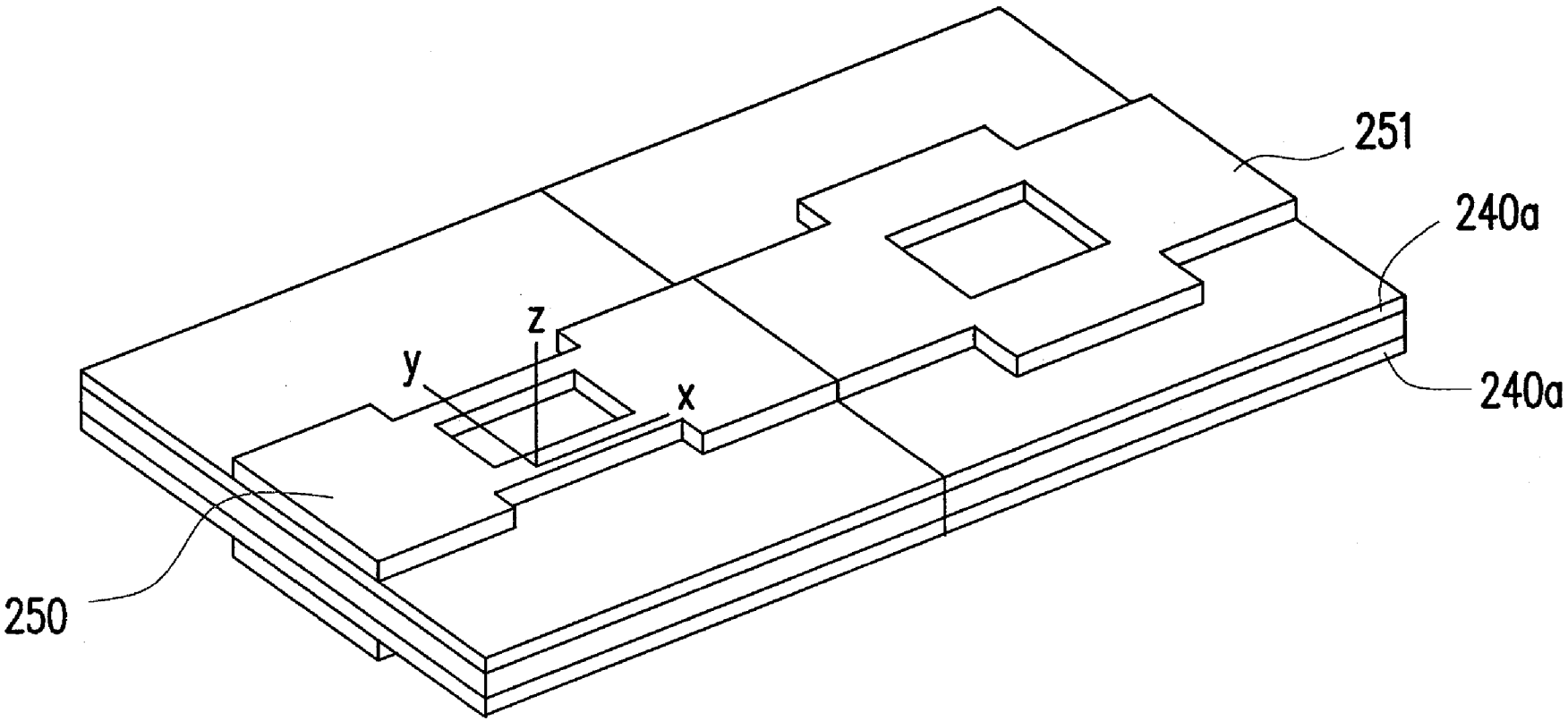
Figure 6I:
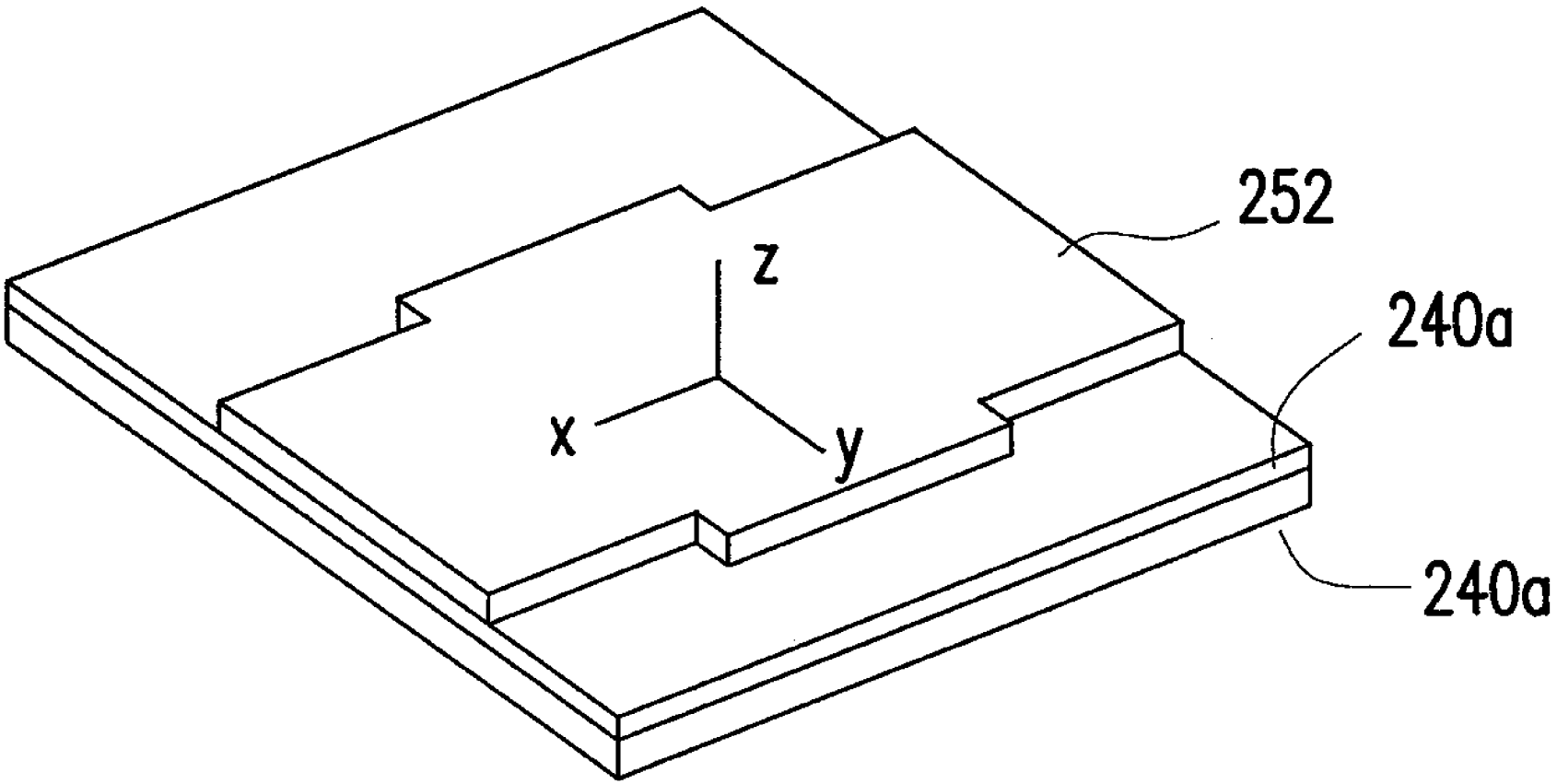
Figure 6J:
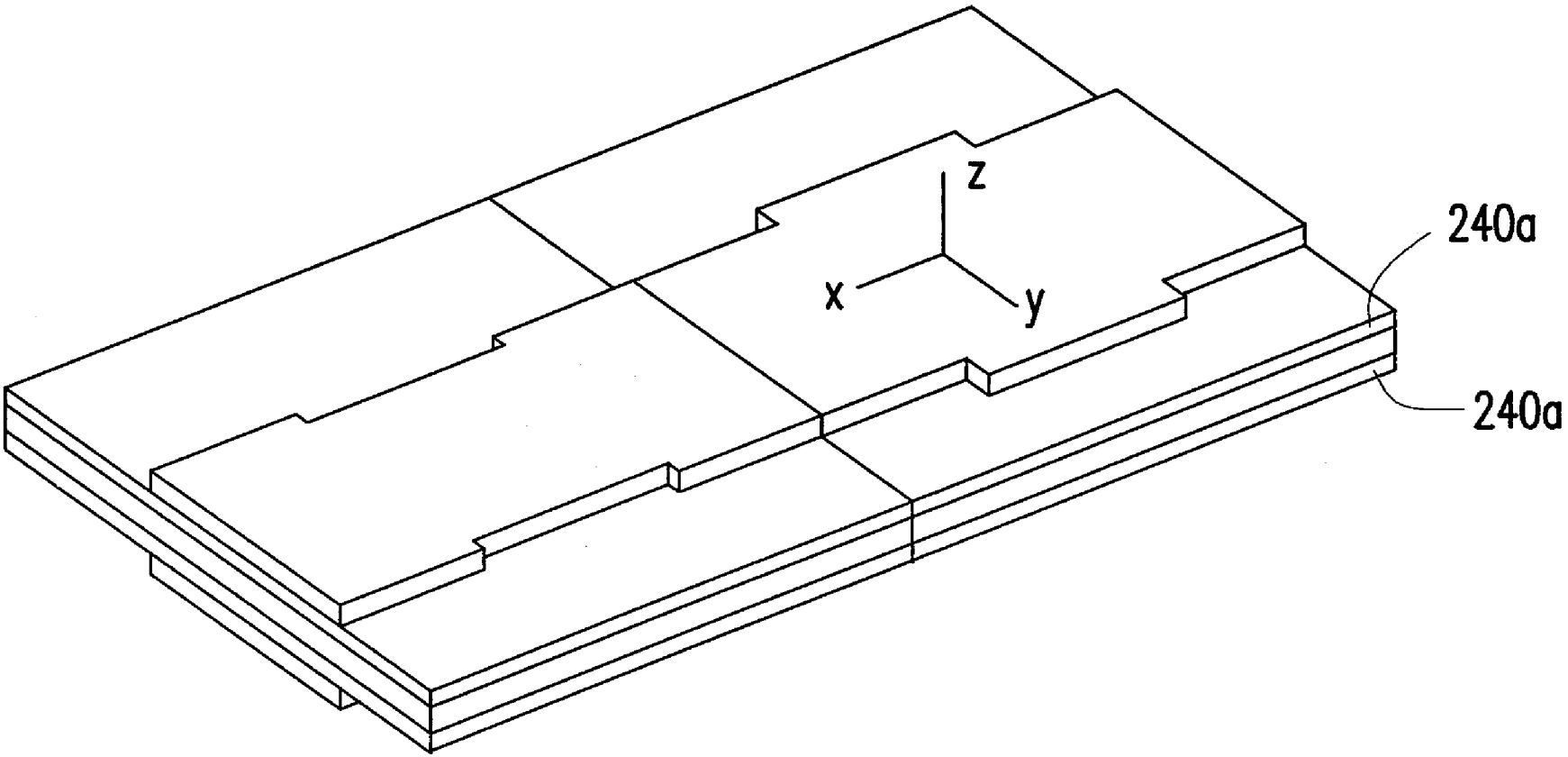

FIG. 6F shows another terminal line structure. Different from FIGS. 6A-6E, in FIG. 6F, the terminal line is arranged periodically and repeatedly with different patterns. The terminal line shown in FIG. 6F adopts a periodically repeating unit formed by combining the pattern structures in FIGS. 6C and 6D. The terminal line shown in FIG. 6G adopts a periodically repeating unit formed by combining the pattern structures in FIGS. 6C and 6E. The terminal line shown in FIG. 6H adopts a periodically repeating unit formed by combining the pattern structures in FIGS. 6E and 6D. The structure shown in FIG. 6J is a variation of the above.

The above examples show a dual-layer structure of making a terminal line on each side of a PCB. The structure of the terminal line 252 shown in FIG. 6I is a single-layer structure.

The aforementioned examples are only intended to indicate that the periodically arranged structures of the terminal line can be combined or altered at random, not limited to a specific pattern or size. As long as the pattern of the terminal line is periodically altered, i.e., the width of the area, the width and height of the cross-section, and length etc., are properly altered, the capacitors and inductors can be controlled, so as to make the connector function as a filter.

The Third Embodiment

Figure 7:
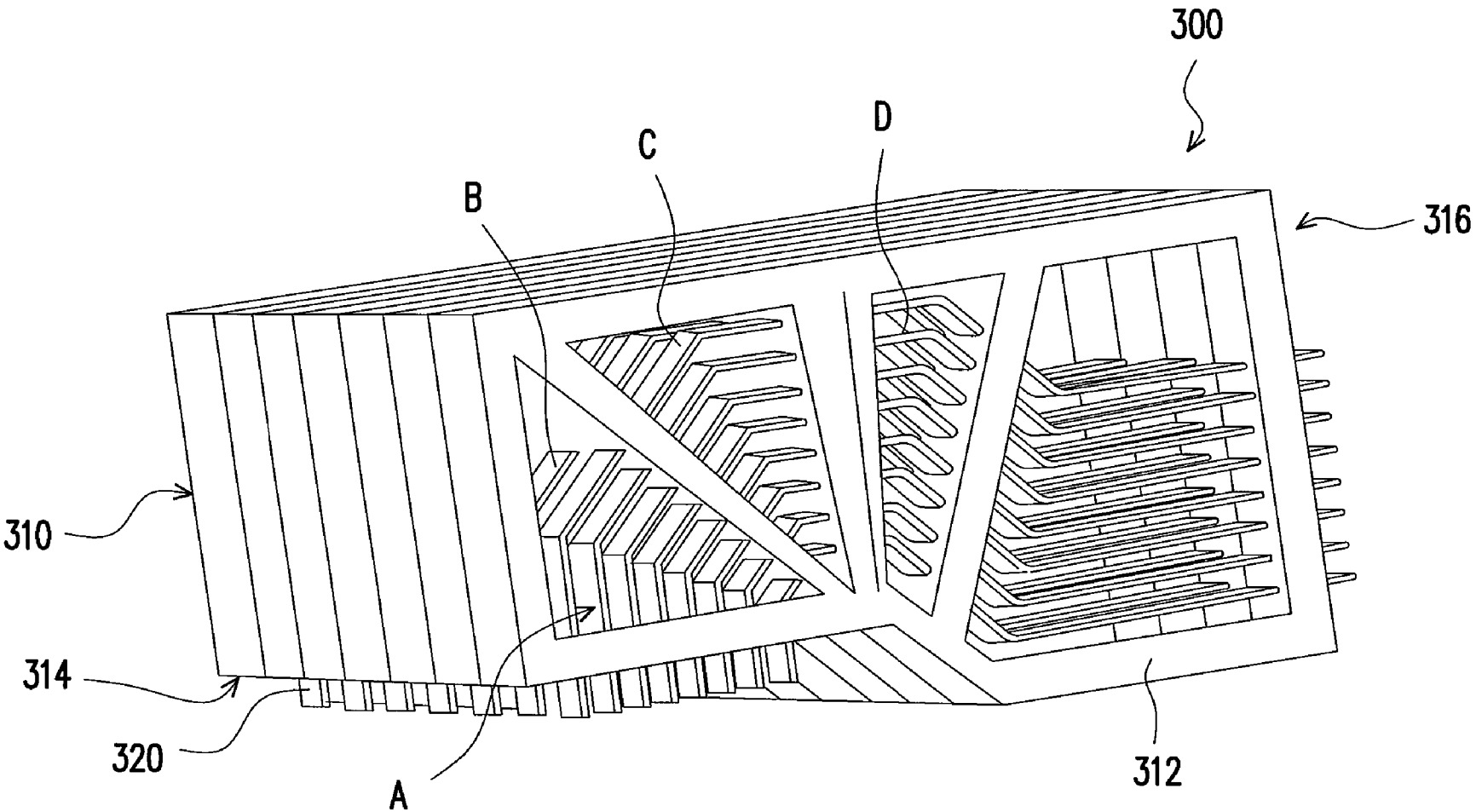
FIG. 7 schematically illustrates a connector according to another embodiment of the present invention.

FIG. 7 is a schematic view of a connector according to another embodiment of the present invention. The connector in FIG. 7 is of a 90° array-type connector structure. That is, each terminal line 320 of the connector 300 turns for an angle of 90° from the input portion to the output portion. Each plastic package (serving as a dielectric material or dielectric layer) 310 has two opposite side surfaces 312 (the other surface is not shown), a signal input side 314, and a signal output side 316. Openings are formed in each side surface 312, for example, openings A, B, C, and D, to expose the terminal lines 320.

The openings A, B, C, and D are arranged in the side surface in a radial pattern, so as to make each plastic package 310 have a periodic structure. The spacers between the openings are also plastic packages, which have the same function of fixing and adjusting the capacitance as the plastic packages in FIGS. 1B and 2B.

Each terminal line 320 turns for an angle of 90° from the input side 314 to the output side 316, and the bent portions of the terminal lines 320 are corresponding to openings in the plastic packages. In other words, the bent terminal lines 320 are also arranged in a radial pattern, and characterized in a periodic structure. Further, each terminal line 320 has the patterns described in the First and Second Embodiments, such that the terminal line 320 presents the characteristic of a periodic structure.

In this embodiment, each terminal line 320 is not merely directly bent by 90° to achieve the structure with the input and output form an angle of 90°, instead, the terminal line 320 has a plurality of bent portions thereby achieving the structure with the input and output form an angle of 90°.

Further, the above example illustrates by a structure with the input and output form an angle of 90°, and the angle is a predetermined angle, not limited to 90°. The practical angle is determined according to the practical design requirement.

The width, length, and the proportion and length of the bent portion of each terminal line 320 are adjusted to control the equivalent capacitors and inductors, so as to make the connector 300 also function as a filter.

Figure 8B:
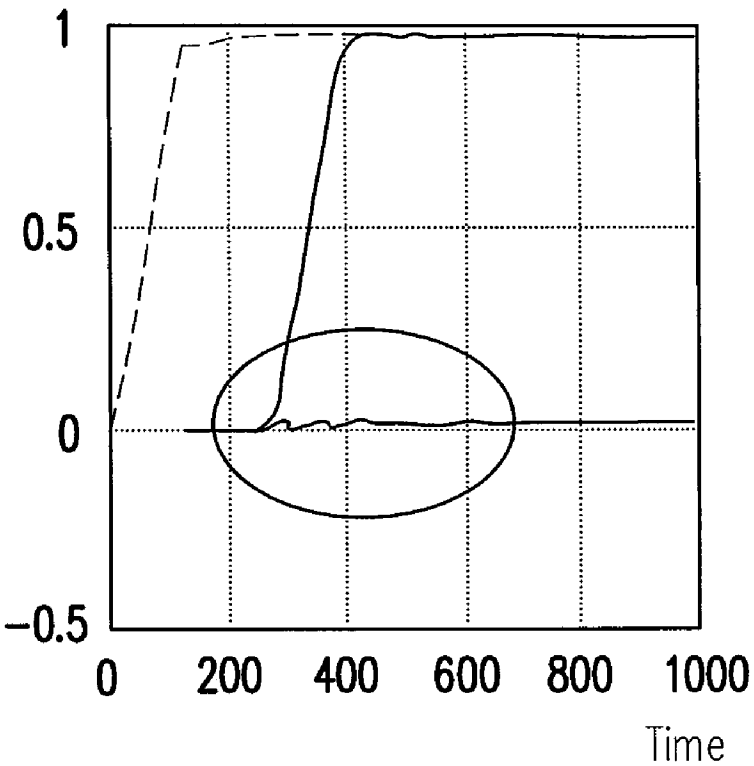
FIG. 8B illustrates waveforms of an input signal and its corresponding output signal using the connector structure of the embodiment of the present invention.
Figure 8A:
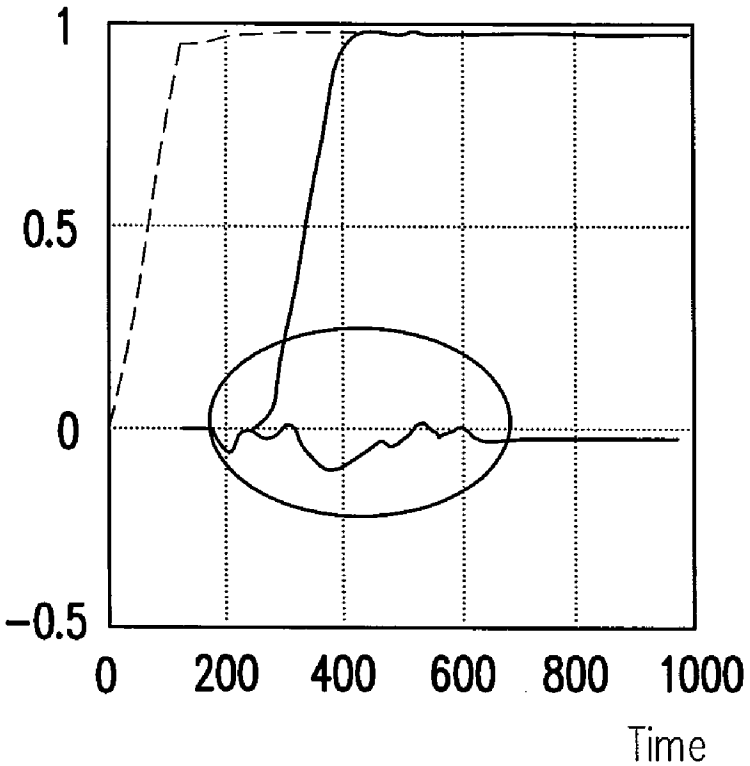
FIG. 8A illustrates waveforms of an input signal and its corresponding output signal without using the connector structure of the embodiment of the present invention.

FIG. 8A shows waveforms of an input signal and its corresponding output signal without the connector structure of embodiments of the present invention. FIG. 8B shows waveforms of an input signal and its corresponding output signal using the connector structure of embodiments of the present invention. As shown in FIG. 8A, after an input signal marked by the broken line is input and then output, great crosstalk noises are generated at the rising edge, as the circled portion in FIG. 8A. As shown in FIG. 8B, after the connector of any one of the aforementioned embodiments is applied,, the crosstalk signal noises generated at the input end portion are almost eliminated. Thus, this embodiment can indeed effectively restrict the crosstalk noises at the connector end.

In summary, the present invention adds the terminal lines and/or plastic packages with periodic pattern into the connector structure, so as to provide the connector with equivalent capacitors and inductors. Thereby, the connector itself functions as a filter.

Moreover, the filter function is achieved by altering the shape of the elements of the connector instead of adding electronic components. Thus, the structure of the connector remains light and flexible without asking for extra space.

Further, as the connector is fabricated by an existing process and devices, no extra cost is required.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A connector with filter function, comprising:

a plurality of terminal lines, wherein the terminal lines are arranged in an array structure, an input side and an output side of each of the terminal lines are substantially arranged linearly, and each of the terminal lines is arranged periodically and repeatedly with a predetermined periodic unit pattern;

a dielectric layer, with a periodic unit pattern, filled between the terminal lines; and a plurality of plastic packages, respectively enclosing the terminal lines with a certain space in between, wherein the predetermined periodic unit pattern is substantially a cuboid, and in the longitudinal direction of the cuboid, the width at a center portion of the predetermined periodic unit pattern is larger or smaller than the rest of the cuboid.

2. The connector with filter function as claimed in claim 1, wherein the array structure is a two-dimensional or a three-dimensional array structure.

3. The connector with filter function as claimed in claim 1, wherein the center portion further comprises at least one opening.

4. The connector with filter function as claimed in claim 1, wherein the predetermined periodic unit pattern is substantially a cuboid, and a center portion of the cuboid comprises at least one opening.

5. The connector with filter function as claimed in claim 1, wherein each of the terminal lines is further arranged periodically and repeatedly with at least two different predetermined periodic unit patterns.

6. A connector with filter function, comprising:

a plurality of terminal lines, wherein the terminal lines are arranged in an array structure, each of the terminal lines comprises a plurality of bent portions, such that an input side and an output side of each of the terminal lines form a predetermined angle, and each of the terminal lines is further arranged periodically and repeatedly with a predetermined periodic unit pattern;

a dielectric layer, with a periodic unit pattern, filled between the terminal lines; and a plastic package, for enclosing the terminal lines, and exposing two end portions of each of the terminal lines to respectively serve as an input end and an output end, wherein the predetermined periodic unit pattern is substantially a cuboid, and in the longitudinal direction of the cuboid, the width at a center portion of the predetermined periodic unit pattern is larger or smaller than the rest of the cuboid.

7. The connector with filter function as claimed in claim 6, wherein the array structure is a two-dimensional or three-dimensional array structure.

8. The connector with filter function as claimed in claim 6, wherein the center portion further comprises at least one opening.

9. The connector with filter function as claimed in claim 6, wherein the predetermined periodic unit pattern is substantially a cuboid, and a center portion of the cuboid comprises at least one opening.

10. The connector with filter function as claimed in claim 6, wherein each of the terminal lines is further arranged periodically and repeatedly with at least two different predetermined periodic unit patterns.

* * * * *